US006387455B1

(12) United States Patent
Katagiri et al.

(10) Patent No.: US 6,387,455 B1
(45) Date of Patent: May 14, 2002

(54) COATING METHOD AND APPARATUS INCLUDING AN AIR SHIELDING DEVICE

(75) Inventors: Yoshinobu Katagiri; Kazuhiro Oki; Kiyoshi Kobayashi; Satoru Fujisaki; Kimio Yukawa, all of Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/358,730

(22) Filed: Jul. 22, 1999

(30) Foreign Application Priority Data

Jul. 22, 1998 (JP) ..... 10-206466

(51) Int. Cl.[7] ..... B05D 1/30; B05C 5/00

(52) U.S. Cl. ..... 427/420; 118/324; 118/504; 118/DIG. 4

(58) Field of Search ..... 427/420; 118/DIG. 4, 118/324, 504

(56) References Cited

U.S. PATENT DOCUMENTS

| | | | |
|---|---|---|---|
| 3,867,901 A | 2/1975 | Greiller | 118/50 |
| 4,842,900 A | 6/1989 | Miyamoto | 427/348 |
| 5,181,963 A | 1/1993 | Degrauwe et al. | 118/325 |
| 5,338,359 A | 8/1994 | Conroy et al. | 118/412 |
| 5,624,715 A * | 4/1997 | Gueggi et al. | 427/420 |

FOREIGN PATENT DOCUMENTS

| | | |
|---|---|---|
| EP | 0 489 978 A1 | 6/1992 |
| JP | 62-289264 | 12/1987 |
| JP | 3-65266 | 3/1991 |
| JP | 3-123657 | 5/1991 |
| JP | 3-123658 | 5/1991 |
| JP | 8-62774 * | 3/1996 |
| JP | 2767712 | 4/1998 |

OTHER PUBLICATIONS

2244 Research Disclosure XP–002132160; Jan. 1980, Havant.

* cited by examiner

*Primary Examiner*—Katherine A. Bareford
(74) *Attorney, Agent, or Firm*—Sughrue Mion, PLLC

(57) ABSTRACT

The coating apparatus has an air shielding device to prevent a curtain of coating liquids, which free-falls from a coating head, from being disturbed by an air carried along by a traveling web. The coating apparatus also has a device to move the air shielding device. Before and at the start of coating, the air shielding device is kept far from an impingement position where the free-falling curtain impinges onto the web. Just after the start of coating, the air shielding device is moved close to the impingement position. This prevents the air shielding device from being contaminated with splashes of the coating liquids, and the like.

15 Claims, 4 Drawing Sheets

F I G. 4 ( a )
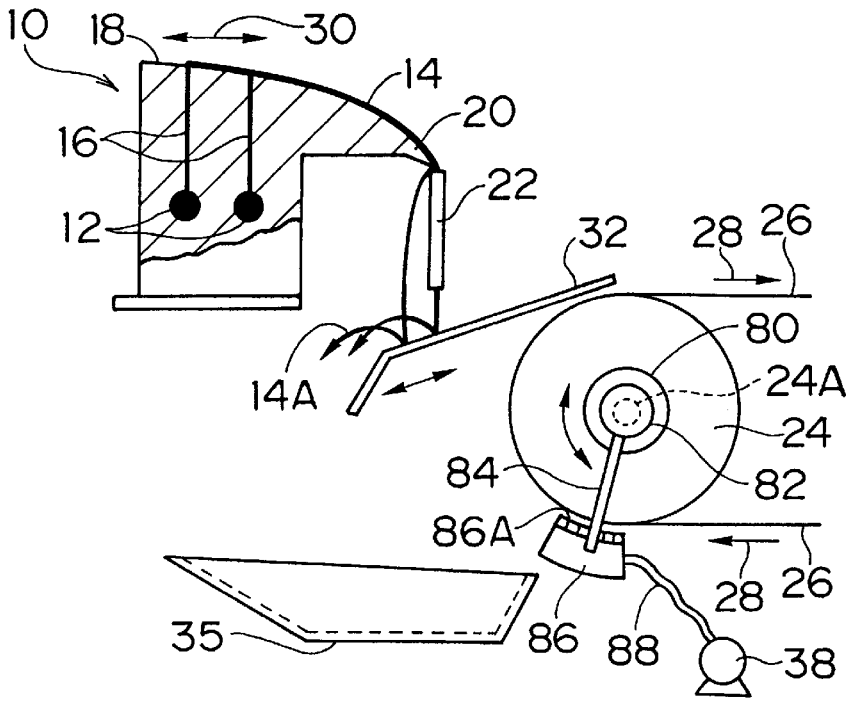
F I G. 4 ( b )
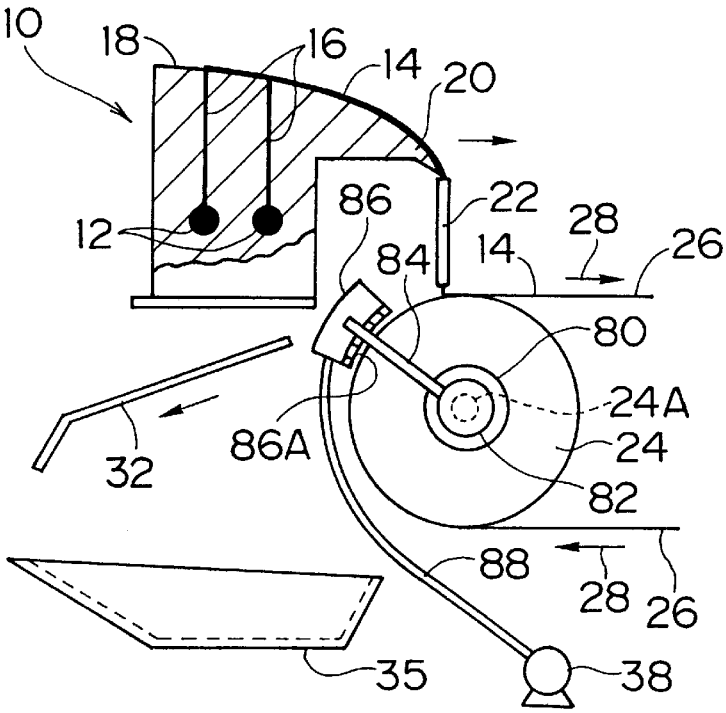

COATING METHOD AND APPARATUS INCLUDING AN AIR SHIELDING DEVICE

BACKGROUND OF THE INVENTION

1. Field of the Invention

The present invention relates generally to a coating method and apparatus, and more particularly to a curtain-coating method and apparatus for coating a continuous web with liquid compositions in the manufacture of photographic film, photographic printing paper, magnetic recording tapes, adhesive tapes, pressure-sensitive recording paper, offset printing plates, and so forth.

2. Description of Related Art

In curtain coating, a traveling web or object is coated by a free-falling curtain of coating liquid that is caused to impinge onto the traveling web or object to form a layer thereon. The curtain coating apparatus is widely used for the manufacture of photographic film, etc., which require a uniform coating.

If the web travels at a high speed, the free-falling curtain is disturbed by an air carried along by the traveling web. This causes the web to be unevenly coated. To solve this problem, there has been proposed a variety of coating apparatuses with air shielding means: a coating apparatus in which a plurality of curried air shields are attached to a coating head (U.S. Pat. No. 3,867,901); a coating apparatus in which a vacuum chamber is arranged close to a web on a backup roller (Japanese Patent No. 2,767,712); a coating apparatus in which an air shield member having a plane parallel to a web is arranged close to the web (Japanese Patent Provisional Publication No. 3-123658); a coating apparatus provided with a means for jetting air in opposition to the air carried along by the traveling web (Japanese Patent Provisional Publication No. 3-65266); and a coating apparatus that blocks the air carried along by the traveling web by arranging an elongated brush extending across the web (U.S. Pat. No. 5,181,963).

The air shielding means of these conventional coating apparatuses must be arranged as close as possible to an impingement position where the free-falling curtain impinges onto the web. That is because the airflow cannot be effectively blocked if the air shielding means is located away from the impingement position.

However, if the air shielding means is arranged close to the impingement position in the conventional coating apparatuses, the air shielding means is contaminated with the coating liquids due to splashes of the coating liquids when a curtain deflector moves at the start of the coating. Consequently, the coating liquids that adhere to the air shielding means drop onto the web during the coating and cause the uneven coating.

To solve this problem, in the coating apparatus of U.S. Pat. No. 5,338,359, a preparation pan is positioned beneath the hopper lip during hopper preparation wherein flow within the hopper is chaotic and the curtain is not stable. The preparation pan includes edge walls spaced apart from the edge guides to stabilize the unsteady curtain within the preparation pan. The coating apparatus minimizes splashing and splattering of the coating liquids thereby minimizing contamination of the coating equipment.

In the coating apparatus of U.S. Pat. No. 5,338,359, however, an elevator for moving up and down the preparation pan works incorrectly since the elevator is contaminated with the coating liquids. Moreover, it is impossible to move the preparation pan with a large capacity within a limited space. Thus, it is necessary to use a small-sized preparation pan and discharge the coating liquids collected in the preparation pan.

SUMMARY OF THE INVENTION

In view of the foregoing, it is an object of the present invention to provide a coating method and apparatus that prevents an air shielding device from being contaminated with coating liquids due to splashes of a free-falling curtain, and the like.

To achieve the above-mentioned object, the present invention is directed to a coating method, comprising the steps of: causing a curtain of a coating liquid to free-fall from a coating head; starting to coat a traveling web with the coating liquid by causing the curtain of the coating liquid to impinge onto the traveling web; and moving, just after the starting step, an air shielding device close to an impingement position where the curtain of the coating liquid impinges onto the traveling web so as to shield the curtain of the coating liquid from an air carried along by the traveling web, the air shielding device being withdrawn from the impingement position before and at the starting step.

To achieve the above-mentioned object, the present invention is also directed to a coating apparatus, comprising: a coating head from which a curtain of a coating liquid free-falls, the curtain of the coating liquid impinging onto a traveling web to coat the traveling web with the coating liquid; an air shielding device for shielding the curtain of the coating liquid from an air carried along by the traveling web; and a moving device for moving, just after a start of coating, the air shielding device close to an impingement position where the curtain of the coating liquid impinges onto the traveling web, the air shielding device being withdrawn from the impingement position before and at said start of coating.

According to the present invention, the coating apparatus has the moving device for moving the air shielding device close to the impingement position where the free-falling curtain impinges onto the web, just after the start of coating. This prevents the air shielding device from being contaminated with splashes of the coating liquids, and the like.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIGS. 4(*a*) and 4(*b*) are explanation drawings showing the fourth embodiment of the coating apparatus according to the present invention.

DETAILED DESCRIPTION OF THE PREFERRED EMBODIMENT

This invention will be described in further detail by way of example with reference to the accompanying drawings.

Figure 1A:
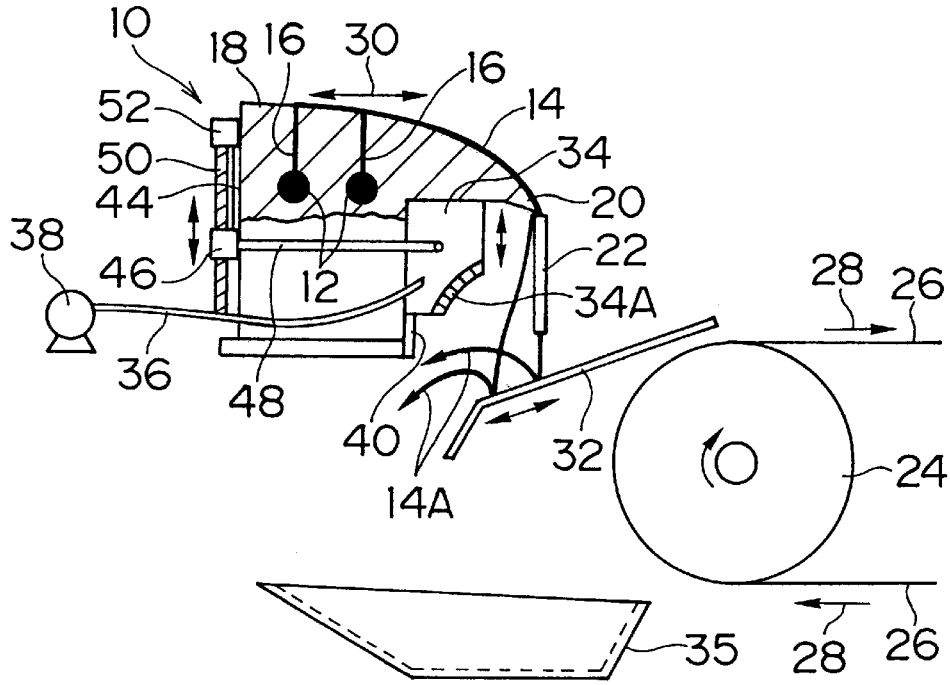
FIGS. 1(*a*) and 1(*b*) are explanation drawings showing the first embodiment of a coating apparatus according to the present invention.
Figure 1B:
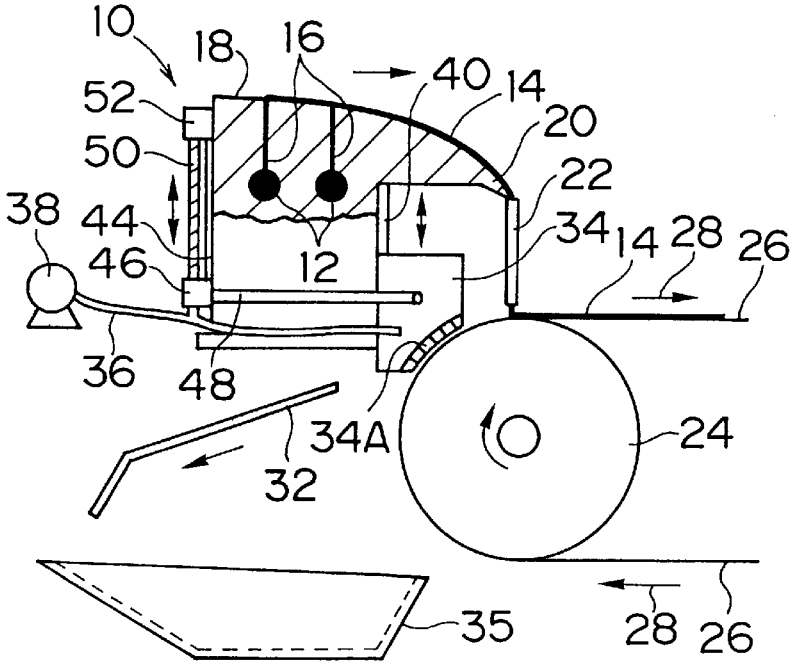

FIGS. 1(*a*) and 1(*b*) are explanation drawings showing the first embodiment of a coating apparatus according to the present invention.

As shown in FIGS. 1(*a*) and 1(*b*), coating liquids are supplied to manifolds 12 in a coating head 10. The coating liquids flow up through slots 16, and they flow out onto a slide surface 18. Then, the coating liquids form two layers and flow down on the slide surface 18. The coating liquids flowing down the slide surface 18 become a coating liquid curtain 14 and free-fall from a lip 20, which projects at the end of the slide surface 18. Both side edges of the free-falling curtain 14 are guided along edge guides 22.

A backup roller 24 is placed below the coating head 10. A traveling web 26 is supported on the backup roller 24 to change the traveling direction from the downside to the upside of the backup roller 24 as indicated with arrows 28 in FIG. 1(*a*). The backup roller 24 prevents the web 26 from vibrating when the web 26 is coated with the free-falling curtain 14 from the coating head 10.

A movement mechanism (not shown) moves the coating head 10 horizontally as indicated by an arrow 30 in FIG. 1(*a*), so that the coating head 10 moves closer to or farther from the backup roller 24. During the preparation for coating, the coating head 10 is placed far from the backup roller 24 so that a curtain deflector 32 can be arranged in a space between the coating head 10 and the backup roller 24. A movement mechanism (not shown) positions the curtain deflector 32 between the coating head 10 and the backup roller 24, or moves the curtain deflector 32 to its original position. During the preparation for the coating, the curtain deflector 32 is placed between the coating head 10 and the backup roller 24. The curtain deflector 32 receives the coating liquid curtain 14 free-falling from the coating head 10 and guides the free-falling curtain 14 into a preparation pan 35 until the free-falling curtain 14 stabilizes.

An air shielding device or a vacuum chamber 34 with an inlet 34A is placed in a space between the front wall of the coating head 10, facing the backup roller 24, and the bottom of the lip 20. The inlet 34A is curved correspondingly to a curvature of the backup roller 24. The vacuum chamber 34 is connected to a suction device 38 through a flexible hose 36. The vacuum chamber 34 is slidably supported on a rail 40, which is provided on the front wall of the coating head 10, through a linear bearing (not shown). On the other hand, a rail 44 is provided on the rear wall (the opposite side of the front wall) of the coating head 10. A nut member 46 is slidably supported on the rail 44, and the nut member 46 connects to the vacuum chamber 34 through an arm 48. A vertical screw member 50 is engaged with the nut member 46, and the top end of the screw member 50 is supported by a motor 52, which is capable of rotating forward and backward. Running the motor 52 moves up or down the nut member 46 along the rail 44, to thereby move up or down the vacuum chamber 34 through the arm 48.

A description will now be given of the operation of the first embodiment of the coating apparatus, which is constructed in the above-mentioned manner. Before the preparation for coating, the coating head 10 is positioned far from the backup roller 24 as shown in FIG. 1(*a*), and the curtain deflector 32 is moved to the space between the coating head 10 and the backup roller 24. Then, the free-falling curtain 14 fallen from the coating head 10 is guided into the preparation pan 35 through the curtain deflector 32. Before the preparation, the motor 52 raises the vacuum chamber 34 to the top end of the front wall of the coating head 10. This prevents the vacuum chamber 34 from being contaminated with splashes 14A of the coating liquids even if the free-falling curtain 14 impinges onto the curtain deflector 32 and the splashes 14A occur, or even if the free-falling curtain 14 does not fall straight due to the disturbance. It is desirable to stop the suction device 38 or use a valve member (not shown), and the like to reduce the suction power in order to prevent the vacuum chamber 34 from sucking the mists of the splashes 14A.

When the free-falling curtain 14 stabilizes, the coating head 10 is moved toward the backup roller 24 up to a coating start position as shown in FIG. 1(*b*), and the curtain deflector 32 is moved down to the original position to start coating the web 26. Just after the start of coating, the motor 52 lowers the vacuum chamber 34 so that the inlet 34A of the vacuum chamber 34 can be close to a free-falling curtain impingement position on the web 26, and then the suction device 38 starts operating or increases the suction power. The air carried along by the web 26 is sucked by the vacuum chamber 34, and the free-falling curtain 14 from the coating head 10 is not disturbed. This prevents the web 26 from being coated unevenly with the free-falling curtain 14. Since the free-falling curtain 14 from the coating head 10 is stable during the coating, the vacuum chamber 34 is not contaminated with the splashes of the coating liquids, the disturbance of the curtain and the like.

Figure 2A:
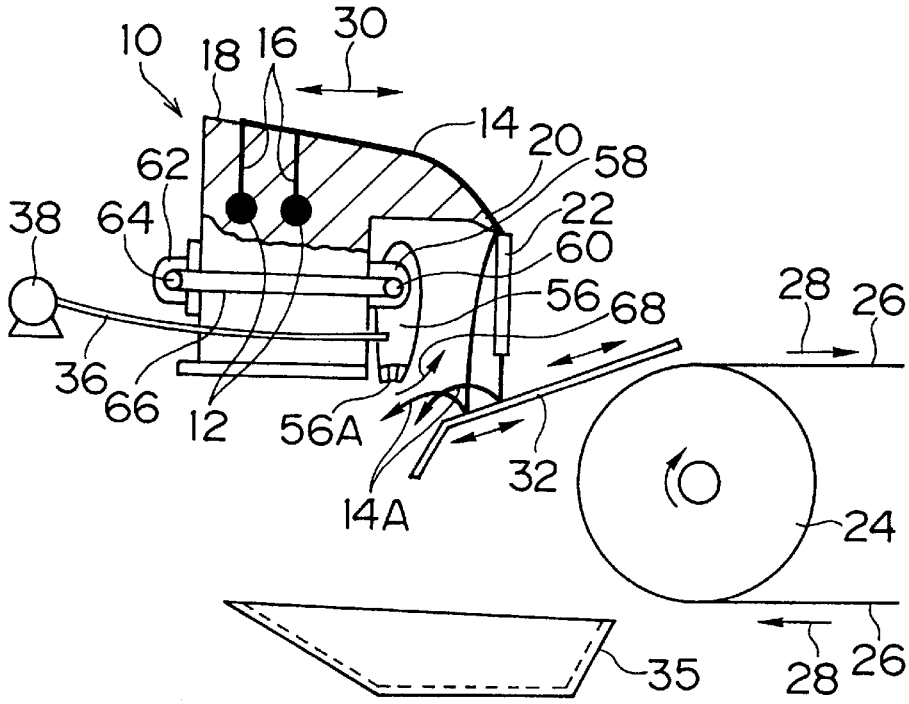
FIGS. 2(*a*) and 2(*b*) are explanation drawings showing the second embodiment of the coating apparatus according to the present invention.
Figure 2B:
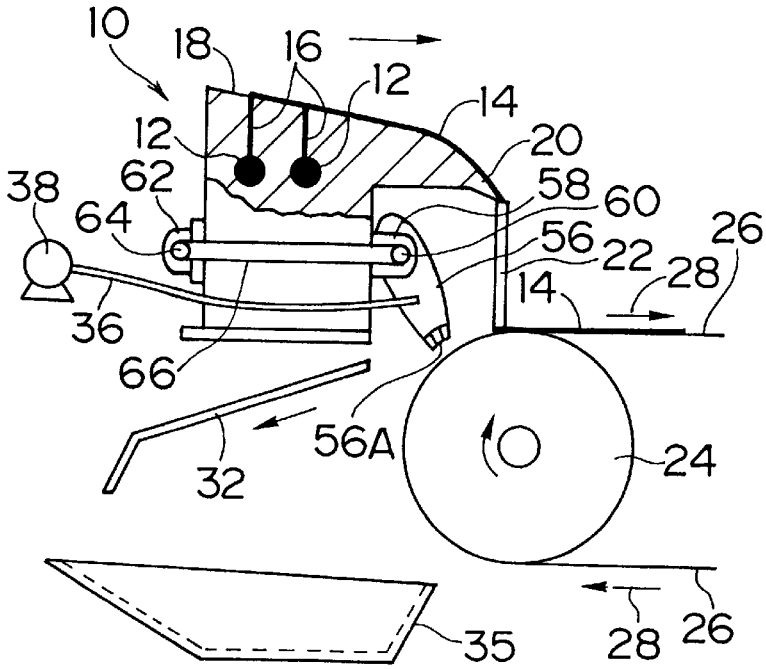

FIGS. 2(*a*) and 2(*b*) are explanation drawings showing the second embodiment of the coating apparatus according to the present invention. The second embodiment is similar to the first embodiment except for an air shielding device and a moving device therefor. Thus, a description will only be given of the structure and operation of the air shielding device and the moving device therefor.

As shown in FIGS. 2(*a*) and 2(*b*), the air shielding device or a vacuum chamber 56 with an inlet 56A is placed in the space between the front wall of the coating head 10, facing the backup roller 24, and the bottom of the lip 20. The inlet 56A is curved correspondingly to the curvature of the backup roller 24. The vacuum chamber 56 is connected to the suction device 38 through the flexible hose 36. The vacuum chamber 56 is rotatably supported on a pair of supporting plates 58, which projects at both ends of the front wall of the coating head 10. A pulley 60 is fitted in a rotary shaft (not shown), which is through one supporting plate 58. A motor 62, which is capable of rotating forward and backward, is supported on the rear wall of the coating head 10. An endless belt 66 is wound between a pulley 64, which is fitted in a rotary shaft (not shown) of the motor 62, and the pulley 60, which is fitted in the rotary shaft of the vacuum chamber 56. Consequently, the motor 62 swings the vacuum chamber 56 in a direction indicated with an arrow 68 in FIG. 2(*a*) through the endless belt 66. Thus, the vacuum chamber 56 moves closer to or farther from the free-falling curtain 14 from the coating head 10.

Before the preparation for coating, the motor 62 swings the vacuum chamber 56 in a direction to withdraw it from the free-falling curtain 14 as shown in FIG. 2(*a*) in order to prevent the vacuum chamber 56 from being contaminated with the splashes 14A of the coating liquids and the disturbance of the free-falling curtain 14 when the free-falling curtain 14 impinges onto the curtain deflector 32. When the coating head 10 is moved toward the backup roller 24 up to the coating start position as shown in FIG. 2(*b*), the motor 62 swings the vacuum chamber 56 toward the free-falling curtain 14 so that the inlet 56A of the vacuum chamber 56 can be positioned close to the free-falling curtain impingement position on the web 26.

Consequently, the second embodiment of the present invention can achieve the same effects as the first embodiment.

Figure 3A:
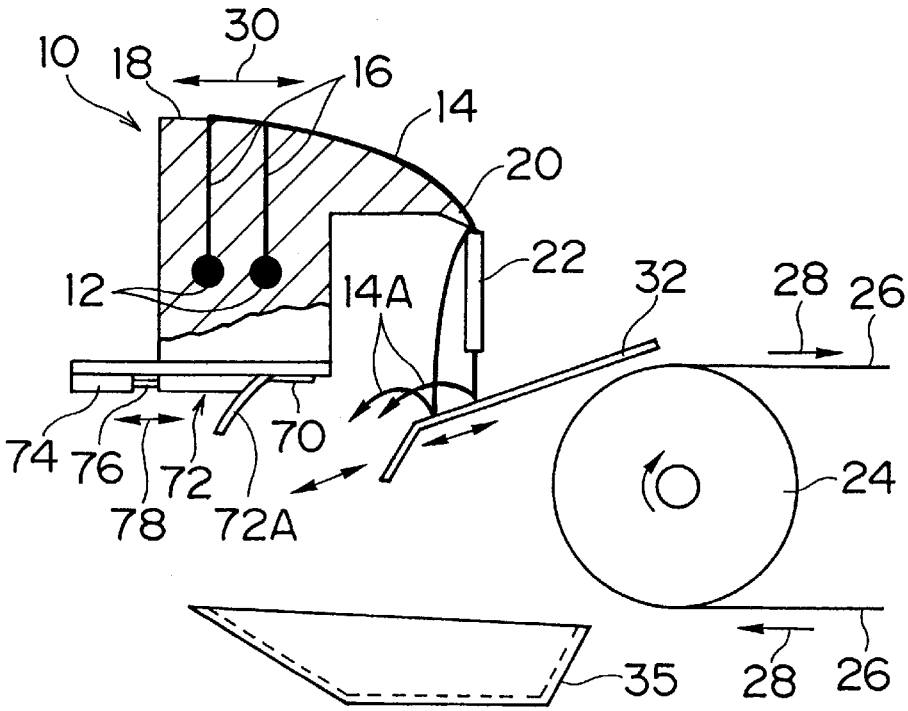
FIGS. 3(*a*) and 3(*b*) are explanation drawings showing the third embodiment of the coating apparatus according to the present invention.
Figure 3B:
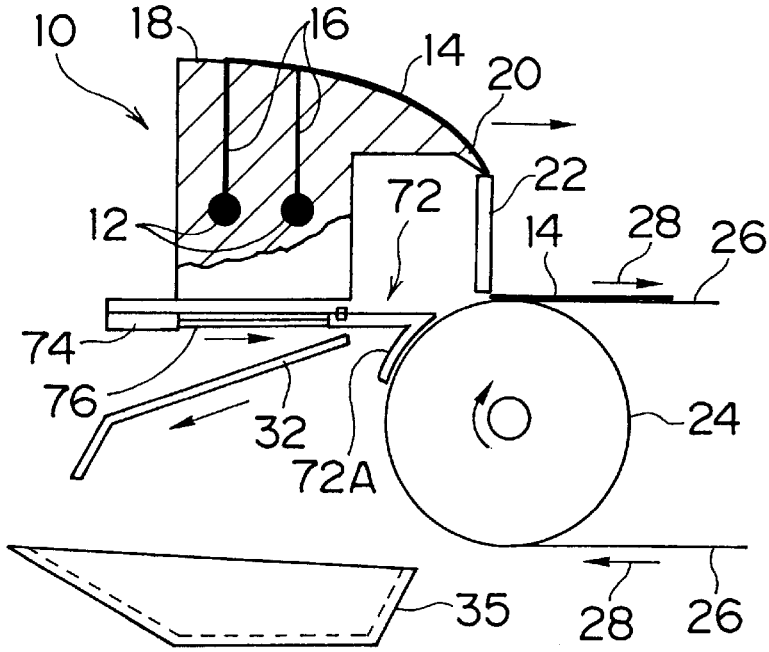

FIGS. 3(*a*) and 3(*b*) are explanation drawings showing the third embodiment of the coating apparatus according to the present invention. The third embodiment is similar to the first embodiment except for an air shielding device and a moving device therefor. Thus, a description will only be given of the structure and operation of the air shielding device and the moving device therefor.

As shown in FIGS. 3(*a*) and 3(*b*), a rail 70 is provided on the bottom of the coating head 10. An air shielding part 72 is slidably supported on the rail 70 through a linear bearing (not shown). The air shielding part 72 includes a labyrinth or an air shield plate 72A with the same curvature as the backup roller 24. The air shielding part 72 is connected to a piston rod 76 of an air cylinder 74, which is supported at the bottom of the coating head 10. Consequently, the air cylinder 74 expands or contracts the piston rod 76 to slide the air shielding part 72 along the rail 70 in a direction indicated with an arrow 78 in FIG. 3(*a*). Thus, the air shielding part 72 becomes closer to or farther from the free-falling curtain 14.

Before the preparation for coating, the air cylinder 74 slides the air shielding part 72 in a direction to withdraw it from the free-falling curtain 14 as shown in FIG. 3(*a*) in order to prevent the air shielding part 72 from being contaminated with the splashes 14A of the coating liquids and the disturbance of the free-falling curtain 14 when the free-falling curtain 14 impinges onto the curtain deflector 32. When the coating head 10 is moved toward the backup roller 24 up to the coating start position as shown in FIG. 3(*b*), the air cylinder 74 slides the air shielding part 72 toward the free-falling curtain 14 so that the air seal plate 72A of the air shielding part 72 can be positioned close to the free-falling curtain impingement position.

Consequently, the third embodiment of the present invention also achieves the same effects as the first embodiment.

FIGS. 4(*a*) and 4(*b*) are explanation drawings showing the fourth embodiment of the coating apparatus according to the present invention. The fourth embodiment is similar to the first embodiment except for an air shielding device and a moving device therefor. Thus, a description will only be given of the structure and operation of the air shielding device and the moving device therefor.

As shown in FIGS. 4(*a*) and 4(*b*), a bearing 80 for a rotary shaft 24A of the backup roller 24 has a disc-shaped rotating device 82, which rotates coaxially with the rotary shaft 24A. An arm 84 extends from the side of the rotating device 82 toward the peripheral edge of the backup roller 24. A vacuum chamber 86 with an inlet 86A is supported at the end of the arm 84. The vacuum chamber 86 is connected to the suction device 38 through an elastic hose 88. The inlet 86A has the same curvature as the backup roller 24. The rotating device 82 rotates the vacuum chamber 86 along a predetermined rotation path from the lower side of the backup roller 24 to a position in the vicinity to the free-falling curtain 14 from the coating head 10. Consequently, the rotating device 82 moves the vacuum chamber 86 close to or farther from the free-falling curtain 14 through the arm 84.

Before the preparation for coating, the rotating apparatus 82 rotates the vacuum chamber 86 to the lower side of the backup roller 24 as shown in FIG. 4(*a*) so as to withdraw the vacuum chamber 86 from the free-falling curtain 14 to thereby prevent the vacuum chamber 86 from being contaminated with the splashes 14A of the coating liquids and the disturbance of the free-falling curtain 14 when the free-falling curtain 14 impinges onto the curtain deflector 32. When the coating head 10 is moved toward the backup roller 24 up to the coating start position to start the coating, the vacuum chamber 86 is rotated so that the vacuum chamber 86 can be close to the free-falling curtain impingement position as shown in FIG. 4(*b*).

Consequently, the fourth embodiment of the present invention also achieves the same effects as the first embodiment.

In these embodiments, the curtain deflector 32 is placed between the coating head 10 and the backup roller 24 during the preparation for coating. The present invention, however, may be applied to the case where the coating apparatus is operated for preparation while directly coating the web 26 with the free-falling curtain 14 without using the curtain deflector 32 to acquire the web as a product after the stabilization of the free-falling curtain 14.

Examples of the webs are paper, plastic film, resin-coated paper, synthetic paper, etc. Examples of plastic materials used for the plastic film are: polyolefine such as polyethylene and polypropylene; vinylpolymer such as polyvinylacetate, polyvinylchloride and polystyrene; polyamide such as 6,6-nylon and 6-nylon; polyester such as polyethylene terephthalate and polyethylene-2,6-naphthalate; polycarbonate; and celluloseacetate such as cellulosetriacetate and cellulosediacetate. An example of a resin used for the resin-coated paper is polyolefine such as polyethylene, but the present invention is not restricted to this. The paper may be laminated with polyolefine, and the surface of the paper may be either flat or embossed. Examples of the coating liquids are: a coating liquid used for forming sensitive emulsion layer, an undercoating layer, a protective layer, a back layer, etc. of a photosensitive material; a coating liquid used for forming a magnetic layer, an undercoating layer, a lubricant layer, a protection layer, a back layer, etc. of a magnetic recording material; and a coating liquid used for forming an adhesive layer, a coloring layer, a rust prevention layer, etc. The coating liquids include a water-soluble binder or an organic solution binder.

As set forth hereinabove, according to the coating method and apparatus of the present invention, the moving device keeps the air shielding device far from the free-falling curtain, which is falling from the coating head, until the start of coating. Just after the start of coating, the moving device moves the air shielding device close to the position where the free-falling curtain impinges onto the web. This prevents the air shielding device from being contaminated with the splashes of the coating liquids, and the like. Thus, the present invention solves the problems that the coating liquids that are adhered to the air shielding device drop onto the web during the coating and deteriorate the quality of the web and that the adhered coating liquids reduce the air shielding effects of the air shielding device.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A coating method comprising the steps of:

causing a curtain of a coating liquid to free-fall from a coating head;

starting to coat a traveling web with a coating liquid by causing the curtain of the coating liquid to impinge onto the traveling web at an impingement position; and moving, just after the starting step, an air shielding device from a first position displaced from said impingement position to a second position proximate to said impingement position where the curtain of the coating liquid impinges onto the traveling web so as to shield the curtain of the coating liquid from an air carried along by the traveling web, the air shielding device being located at said first position at the starting step.

2. A coating apparatus comprising:

a coating head, moveable from a retracted position to an impingement position, said coating head having a front wall and a lip above the front wall from which a curtain of a coating liquid free-falls, the curtain of the coating liquid impinging onto a traveling web at the impingement position to coat the traveling web with the coating liquid;

an air shielding device for shielding the curtain of the coating liquid from an air carried along by the traveling web, said air shielding device being secured to said coating head so as to move therewith; and a moving device for moving, just after the start of coating, the air shielding device from a first position displaced from said impingement position to a second position proximate to said impingement position.

3. The coating apparatus according to claim 2, wherein said air shielding device is slidably supported on a rail, said rail provided on the front wall of the coating head.

4. The coating apparatus according to claim 2, wherein said air shielding device is rotatably supported on a pair of supporting plates, said supporting plates projecting from both ends of the front wall of the coating head.

5. The coating apparatus according to claim 2, also comprising a moveable curtain deflector for guiding said free-falling coating liquid away from said traveling web, while said coating head travels to a position near said impingement position, wherein said moveable curtain deflector moves in a direction away from said impingement position; and a preparation pan for capturing said coating liquid from said moveable curtain deflector.

6. The coating apparatus according to claim 2, wherein the air shielding device comprises a suction chamber.

7. The coating apparatus according to claim 2, wherein the air shielding device comprises a plate with the same curvature as the traveling web at the impingement position.

8. The coating apparatus according to claim 2, further comprising a movement mechanism for moving the coating head closer to and further away from the traveling web, said movement mechanism provided independently of the moving device for the air shielding device.

9. The coating apparatus according to claim 8, wherein the air shielding device comprises a suction chamber.

10. The coating apparatus according to claim 8, wherein the air shielding device comprises a plate with the same curvature as the traveling web at the impingement position.

11. A coating apparatus comprising:

a coating head, moveable from a retracted position to an impingement position, from which a curtain of a coating liquid free-falls, the curtain of the coating liquid impinging onto a traveling web at the impingement position to coat the traveling web with the coating liquid;

an air shielding device for shielding the curtain of the coating liquid from an air carried along by the traveling web;

a rail attached to said coating head, wherein said air shielding device is placed on said rail such that said air shielding device is moved in conjunction with said coating head; and a moving device for moving along said rail, just after the start of coating, the air shielding device from a first position displaced from said impingement position to a second position proximate to said impingement position.

12. The coating apparatus according to claim 11, wherein the air shielding device comprises a suction chamber.

13. The coating apparatus according to claim 11, wherein the air shielding device comprises a plate with the same curvature as the traveling web at the impingement position.

14. The coating apparatus according to claim 11, further comprising a moveable curtain deflector for guiding said free-falling coating liquid away from said traveling web, while said coating head travels to a position near said impingement position, wherein said moveable curtain deflector moves in a direction away from said impingement position; and a preparation pan for capturing said coating liquid from said moveable curtain deflector.

15. The coating apparatus according to claim 11, further comprising a movement mechanism for moving the coating head closer to and further away from the traveling web, said movement mechanism provided independently of the moving device for the air shielding device.

* * * * *